US005957539A

United States Patent [19]

Durup et al.

[11] Patent Number: 5,957,539

[45] Date of Patent: Sep. 28, 1999

[54] PROCESS FOR EXCAVATING A CAVITY IN A THIN SALT LAYER

[75] Inventors: Jean-Gerard Durup, Le Raincy; Guy Boris, Le Kremlin-Bicetre; Yvon Charnavel, Rosny-Sous-Bois, all of France

[73] Assignee: Gaz de France (G.D.F.) Service National, France

[21] Appl. No.: 08/895,983

[22] Filed: Jul. 17, 1997

[30] Foreign Application Priority Data

Jul. 19, 1996 [FR] France ..... 96 09104
Jul. 3, 1997 [FR] France ..... 97 401582

[51] Int. Cl.[6] ..... E21B 43/28; E21F 17/16

[52] U.S. Cl. ..... 299/4; 405/58

[58] Field of Search ..... 299/4, 17; 166/50; 405/55, 58

[56] References Cited

U.S. PATENT DOCUMENTS

| | | | |
|---|---|---|---|
| 2,822,158 | 2/1958 | Brinton | 299/4 |
| 3,339,978 | 9/1967 | Helvenston | 299/4 |
| 3,347,595 | 10/1967 | Dahms et al. | 299/4 |
| 3,510,167 | 5/1970 | Carmody | 299/4 |
| 3,873,156 | 3/1975 | Jacoby | 299/4 |
| 4,411,474 | 10/1983 | Higgins | 299/4 |
| 5,246,273 | 9/1993 | Rosar | 299/4 |

FOREIGN PATENT DOCUMENTS

| | | |
|---|---|---|
| 0066972 | 12/1982 | European Pat. Off. . |
| 9510689 | 4/1995 | WIPO . |

*Primary Examiner*—David J. Bagnell
*Attorney, Agent, or Firm*—Rothwell, Figg, Ernst & Kurz

[57] ABSTRACT

The invention concerns a process for excavating by dissolution an underground cavity in a thin salt layer, in order to store a fluid therein. According to the invention, the process includes the steps of producing an injection duct, an extraction duct, and a void for a communication space which places in communication the injection and extraction ducts, producing at least one blind tunnel void communicating with the communication space so as to enable the solvent to circulate and the salt to dissolve in the blind tunnel, injecting via the injection duct a solvent into the communication space, and extracting via the extraction duct the brine formed by the dissolution of the salt on contact with the solvent. The advantage of this process is that the excavated layer has a mechanically stable shape and a larger volume and is produced more cheaply than with prior processes.

9 Claims, 2 Drawing Sheets

PROCESS FOR EXCAVATING A CAVITY IN A THIN SALT LAYER

BACKGROUND OF THE INVENTION

1. Field of the Invention

The invention concerns a process for excavating by dissolution, an underground cavity in a thin salt layer, for example an underground salt layer.

More particularly, the object of the invention is to obtain, after excavation, a cavity for the storage of a fluid, in particular natural gas, in a salt cavern obtained after the dissolution process.

2. Description of the Background Art

In view of the stresses to which the cavity has to be subjected during its use as an underground gas storage, the dissolution process has to be controlled in order to ensure that the final cavity has a mechanically stable shape.

Although it is relatively easy to control dissolution when the thickness of the available salt is several hundred meters thick or so, this operation is more awkward when the salt is stratified and of more reduced thickness. In fact, even when the thickness of the salt available is only a few hundred metres thick, it becomes necessary to apply specific cavern dissolution processes to develop cavities whose width over height ratio is of the order of 1. When the salt thickness is less than about 100 metres, new salt dissolution processes are needed. The invention concerns a process for developing a tunnel-shaped cavern in such a th in salt layer.

Certainly, U.S. Pat. No. 5,246,273 discloses for the excavation of a salt layer by dissolution:

- producing an injection duct, an extraction duct, a void for a communication space which places the injection and extraction ducts in communication, and at least one void for a blind tunnel such that:
  - the blind tunnel extends between an open end and a closed end; and
  - the blind tunnel communicates via its open end with the communication space;
- then injecting via the injection duct a salt solvent into the communication space in order to excavate the cavity by dissolution of the salt on contact with the solvent; and
- then extracting via the extraction duct the brine formed by the dissolution of the salt.

In this document, U.S. Pat. No. 5,246,273, the communication space and the blind tunnel are excavated as an extension of each other, sloping downwards from the injection shaft such that the closed end of the injection shaft is lower than its open end. The blind tunnel is an optional sump designed to recover the insoluble elements deposited therein.

Consequently, the technique applied in U.S. Pat. No. 5,246,273 is costly since, related to the volume of the final cavity with a mechanically stable shape, the number of production operations is relatively high (in particular producing the ducts and the void for the communication space).

In order to overcome these problems, the invention proposes that, to excavate the cavity, the blind tunnel also be excavated by circulating the solvent in this tunnel, making the solvent pass into the tunnel via its open end from the communication space and recovering the resultant brine so that it can be extracted therefrom.

SUMMARY OF THE INVENTION

As will be appreciated, a blind tunnel is a tunnel which is distinct from the communication space and has a single end communicating with said space.

The advantage of this solution is in particular that it permits a varied range of cavity forms and allows the cavern to be worked in numerous directions.

Consequently this solution enables the volume of the final cavity to be substantially increased without having to move the injection or extraction ducts, whilst preserving a certain degree of mechanical stability. The cost of the excavation operation related to the volume of the cavity is therefore reduced.

It is thus highly advantageous to increase the number of blind tunnel voids connected to the communication space.

This solution is all the more noteworthy since it has an unexpected effect. Indeed, a blind tunnel a priori does not encourage the intake and circulation of the solvent, even less so the mixing of the solvent and dissolution of the salt. However, this is what happens in practice.

Throughout the description the term "void" designates the initial state of a space or tunnel (before the solvent dissolves the salt). It could correspond to a preliminary borehole.

According to the invention, in order to improve dissolution in the blind tunnel, the closed end thereof is disposed at a level which is higher than or substantially the same as that of the open end.

Since the density of the brine is higher than that of the solvent, when the closed end of the blind tunnel is disposed at a lower level than that of the open end, the brine tends to stagnate at the closed end of the blind tunnel. Therefore the solvent no longer circulates in the blind tunnel and the excavation thereof by dissolution tends to stop. This phenomenon is all the more notable, the more pronounced the slope and the longer the blind tunnel.

In order to improve further the dissolution action in the blind tunnel, the invention proposes that, at the point of connection between the communication space void and the blind tunnel void (which point could a priori be disposed anywhere along the communication space void between the two ducts), the open end of the blind tunnel void can be produced such that it overhangs the communication space.

A variant likewise enabling the dissolution action in the blind tunnel to be improved consists in:

- forming the open end of the blind tunnel void in the vicinity of the injection duct;
- circulating the solvent in the injection duct and making it emerge from this duct via an end which forms the point of injection into the cavity; and
- forming the blind tunnel void such that the part with its open end overhangs the injection point.

According to the invention, in order to improve further the dissolution in the blind tunnel:

- the injection and extraction ducts are produced at a spacing from each other;
- an elongate part is provided in the communication space void; and
- the void for the blind tunnel and the elongate part of the communication space void are produced substantially as an extension of each other, and the injection duct is produced between the blind tunnel void and the elongate part of the communication space.

On the other hand, if the cost of producing a cavity is to be reduced or the range of forms produced increased, the invention proposes disposing the inject ion and extraction ducts substantially coaxially, such that one of these ducts is located in the centre and is surrounded by the other, at least over part of its axial length. In this case only one hole has to be excavated in order to produce the two ducts.

BRIEF DESCRIPTION OF THE DRAWINGS

The invention will be understood more clearly from the following description which is given with reference to the appended drawings, wherein.

DETAIL DESCRIPTION OF THE PREFERRED EMBODIMENTS

Figure 1:
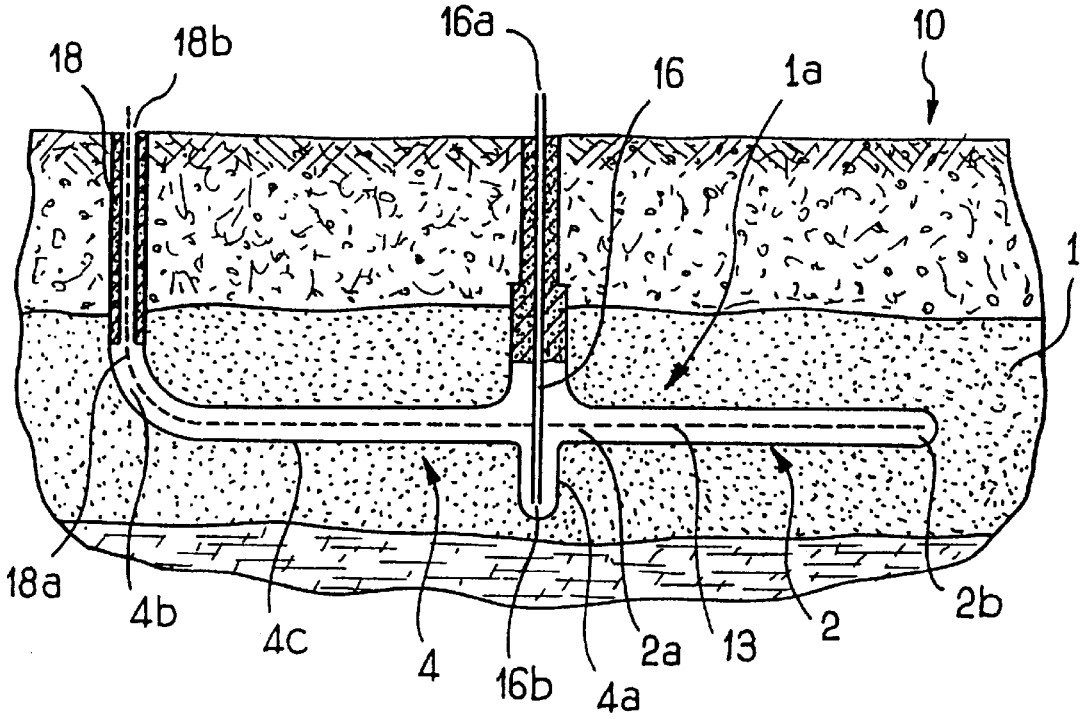
FIG. 1 shows in section a first form of a cavity void made in a salt layer.

FIG. 1 shows a salt layer 1 in stratified form and comprised between two layers of other minerals present in the ground 10. An injection duct 16 and an extraction duct 18 are disposed in two shafts, after excavation thereof, substantially vertically between ground level and a cavity void la excavated in the salt layer 1.

These ducts have one end 16*a*, 18*b* located at ground level and one end 16*b*, 18*a* located in the cavity void 1*a*. The ends 16*b*, 18*a* located in the cavity void 1*a* are connected by a communication space void 4. In this case, the communication space void 4 has been drilled proceeding from the duct 18. The drilling axis 13 is shown in broken lines. The diameter of the void is approximately 6 cm and preferably less than 10 cm.

The communication space void 4 has an elongate, substantially rectilinear and horizontal part 4*c* between an end part 4*b*, connected to the extraction duct 18, and a further end part 4*a* surrounding the injection duct 16 over part of its length, in the vicinity of its end 16*b* which forms a point of injection into the cavity.

A void 2 for a blind tunnel is produced by extending the elongate part 4*c* of the communication space void 4 beyond the injection duct 16. This blind tunnel void 2 therefore comprises a closed end 2*b* and an open end 2*a* communicating with the communication space void 4. The open end 2*a* overhangs the injection point 16*b*, such that the open end 2*a* is disposed in the vicinity of the injection point 16*b* and the lower part of the open end 2*a* is higher than the injection point 16*b*.

Here, the void 4*c* of the elongate part of the communication space and the blind tunnel void 2 are substantially horizontal. They could also be slightly inclined. In this case, owing to the higher density of the brine relative to the water injected, the open end of the blind holes must of necessity be lower than the closed end and, likewise, the elongate part of the communication space must be lower at the extraction duct end than at the injection point end.

Figure 2:
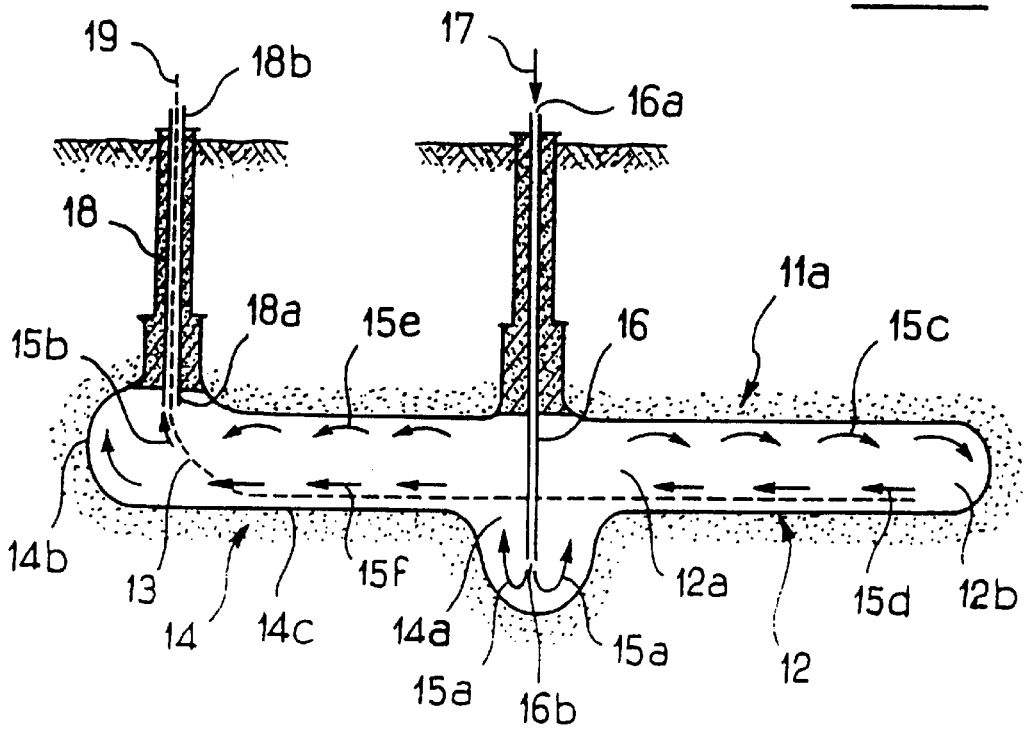
FIG. 2 shows in section a first cavity form obtained from the void of FIG. 1 after excavation by dissolution of some of the salt present in the salt layer.

In FIG. 2 a solvent (in this case water) is injected as shown by the arrow 17 via the end 16*a* of the injection duct 16. The water emerges from the duct 16 at the injection point 16*b* where it is injected into the end 14*a* of the communication space as illustrated by the arrows 15*a*. This communication space, like the cavity as a whole, is entirely or at least almost entirely filled with water and brine. Since the water injected is less dense than the brine, it rises to the upper part of the cavity 11*a*. The water is injected at a pressure which is slightly greater than the pressure prevailing in the cavity.

The injected water circulates from the end 14*a* of the communication space towards the elongate part 14*c* of the communication space 14 and the blind tunnel 12. The water is not introduced owing to the pressure at which it is injected into the blind tunnel but under the effect of a flow created by the dissolution of the salt.

As illustrated by the arrows 15*c*, 15*e*, the water filling this cavity excavates the salt layer by dissolving the salt such that, after excavation, the communication space and blind tunnel voids 4, 2 form the communication space 14 and the blind tunnel 12, of which the widths, lengths and heights are greater than their respective void versions. The salt-charged water forming brine then circulates in the lower parts of the communication space 14 and of the blind tunnel 12, as shown by the arrows 15*d*, 15*f*.

The brine passes from the blind tunnel 12 towards the elongate horizontal part 14*c* of the communication space 14, such that the brine formed in the blind tunnel is recovered in the communication space so as to be extracted therefrom.

By applying an injection pressure which is greater than the extraction pressure, the brine circulates from the elongate part 14*c* of the communication space 14 towards the duct 18 via the end 14*b* of the communication space 14, as shown by the arrow 15*b*.

The blind tunnel 12 communicates with the communication space 14 solely via the open end, which enables the blind tunnel to be flooded with water by introducing water thereinto and recovering the brine formed by dissolution of the salt in the blind tunnel.

Figure 3:
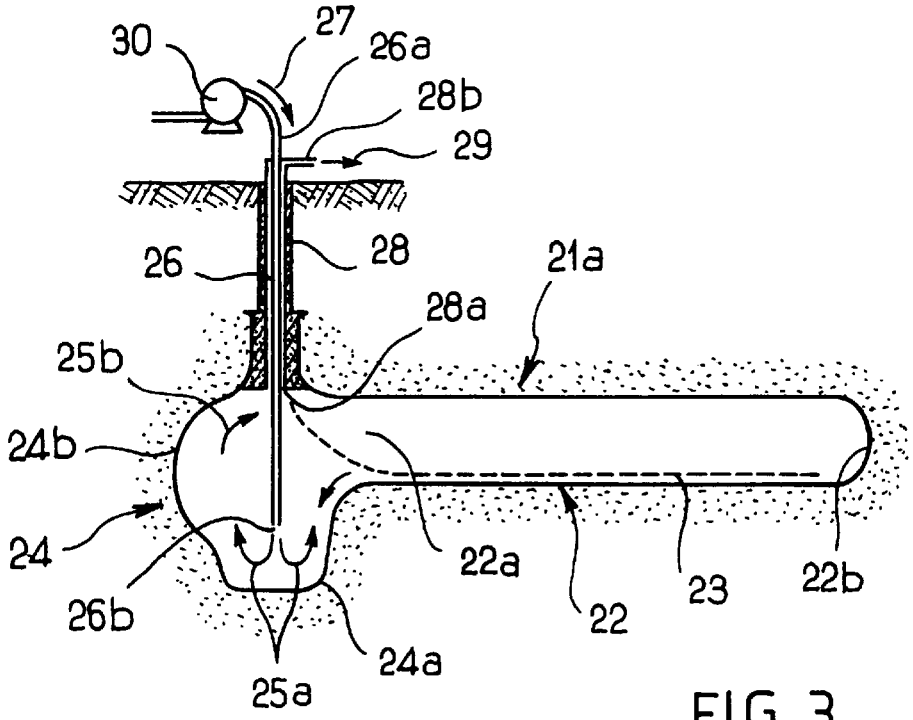
FIG. 3 shows in section a second cavity form obtained after excavation by dissolution of some of the salt present in the salt layer.

In FIG. 3 the parts corresponding to those in FIG. 2 are denoted by the same number increased by 10. This Figure essentially differs from FIG. 2 in that the injection duct 26 and extraction duct 28 are coaxial. Since the injection duct 26 descends the furthest in the cavity 21*a*, it is located on the interior and the extraction duct 28 is located on the exterior. The extraction duct 28 surrounds the injection duct over the major part of its length.

Owing to this particular configuration, the communication space here no longer has a horizontal elongate part and is produced entirely around the injection duct 26 between the ends 26*b*, 28*a* of the injection and extraction ducts. The communication space void can easily be drilled at the same time as the extraction duct is drilled. The axis 23 of the blind tunnel void is shown in broken lines.

Water and hence brine are circulated by means of a compression pump 30 which injects water under pressure into the injection duct 26 as indicated by the arrow 27.

Figure 4:
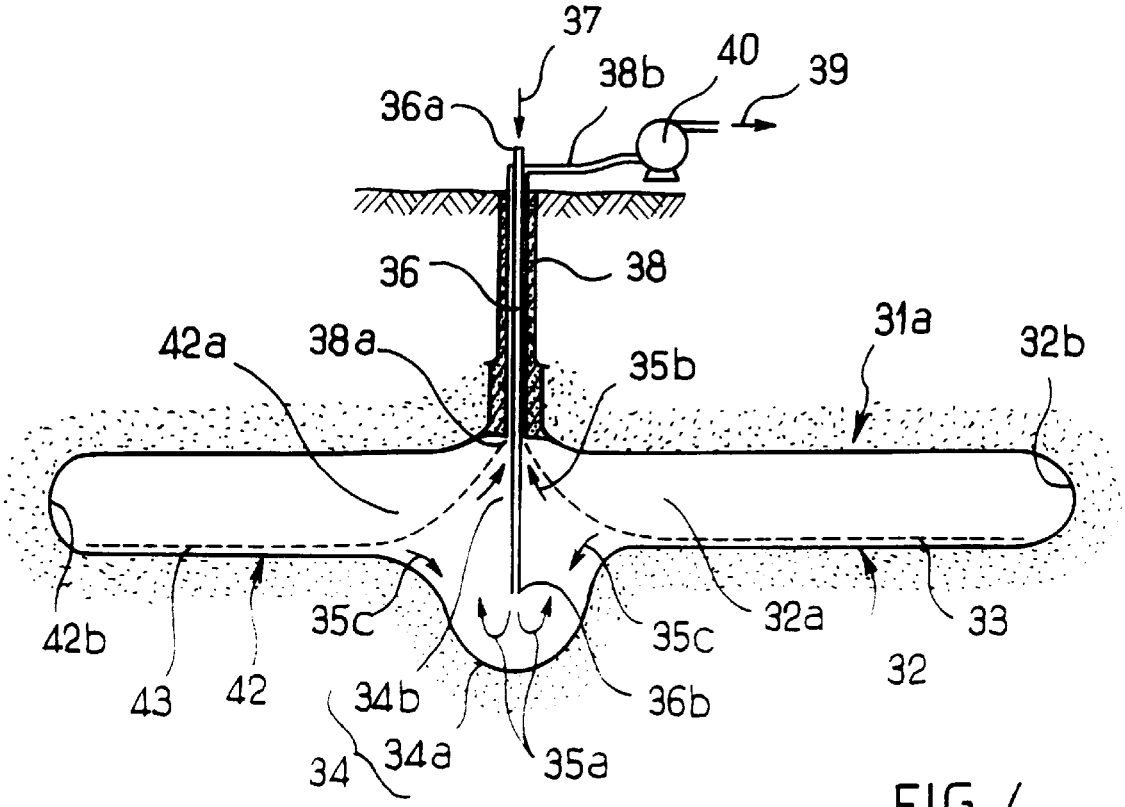
FIG. 4 shows in section a third cavity form obtained after excavation by dissolution of some of the salt present in the salt layer.

In FIG. 4 the parts corresponding to those in FIG. 3 are denoted by the same number increased by 10. This Figure essentially differs from the preceding Figure in that a second blind tunnel void 43 is provided. This Figure illustrates the production of multiple blind tunnels 32, 42 in fluid communication with the communication space 34 via their open ends 32*a*, 42*a*.

The water injected via the injection point 36*b* rises since it is less dense than the brine present in the cavity and since the injection point is located below the open ends 32*a*, 42*a* of the blind holes. The water is then distributed between the various blind tunnels and excavates them, becoming charged with salt as it does so. The resultant brine then tends to descend in the end 34*a* of the communication space, as illustrated by the arrows 35*c*. In practice, the flow 35*a* of injected water guides the brine towards the end 38*a* of the extraction duct 38, as illustrated by the arrows 35*b*. The brine is then extracted via the extraction duct 38.

In this FIG. 4 the water and hence the brine are circulated by means of a suction pump 40 which draws in the brine by means of the extraction duct 38, as illustrated by the arrow 39.

It will be appreciated that the invention is in no way restricted to the embodiments described above. The injection and extraction ducts could be inverted, for example, without thereby modifying the invention.

We claim:

1. Process for excavating by dissolution an underground cavity in a thin salt layer, the process comprising the following steps:

producing an injection duct, an extraction duct, a void for a communication space which places the injection and extraction ducts in communication, and at least one void for a blind tunnel such that:

the blind tunnel extends between an open end and a closed end; and the blind tunnel communicates via its open end with the communication space;

then injecting via the injection duct a salt solvent into the communication space in order to excavate the cavity by dissolution of the salt on contact with the solvent; and then extracting via the extraction duct the brine formed by the dissolution of the salt;

wherein, in order to excavate the cavity, the blind tunnel is also excavated by circulating solvent in this tunnel, making the solvent pass via the open end of the tunnel from the communication space into the tunnel and recovering the resultant brine so that it can be extracted therefrom.

2. Process according to claim 1, wherein the open end of the blind tunnel void is produced such that it overhangs the communication space void at the point where they are connected.

3. Process according to claim 1, wherein:

the open end of the blind tunnel void is provided in the vicinity of the injection duct; and the solvent is circulated in the injection duct, emerges therefrom via an end forming the point of injection into the cavity; and the blind tunnel void is produced such that its open end overhangs the injection point.

4. Process according to claim 1, wherein the injection duct and extraction duct are disposed substantially coaxially such that one of these ducts is located in the centre and is surrounded by the other, at least over part of its axial length.

5. Process according to claim 1, wherein:

the injection duct and extraction duct are produced at a spacing from each other;

an elongate part is provided in the communication space void; and the blind tunnel void and the elongate part of the communication space void are produced substantially as an extension of each other, and the injection duct is produced between the blind tunnel void and the elongate part of the communication space void.

6. Process according to claim 1, wherein a plurality of blind tunnel voids are produced connected to the communication space.

7. Process according to claim 1, wherein the blind tunnel void has a diameter of less than 10 cm.

8. Cavity obtained by implementing the process according to claim 1.

9. Process for excavating by dissolution a cavity in ground predominantly containing salt, the process comprising the following steps:

producing an injection duct, an extraction duct, a void for a communication space which places in communication the injection and extraction ducts, and at least one void for a blind tunnel such that:

the blind tunnel extends between an open end and a closed end; and the blind tunnel communicates via its open end with the communication space;

then injecting via the injection duct a salt solvent into the communication space in order to excavate the cavity by dissolution of the salt on contact with the solvent;

then extracting via the extraction duct the brine formed by the dissolution of the salt; wherein, in order to excavate the cavity, the blind tunnel is likewise excavated by circulating solvent in this tunnel, by disposing the closed end of the blind tunnel at a level which is higher than or substantially the same as that of the open end, and making the solvent pass into the tunnel via its open end from the communication space and recovering the resultant brine so that it can be extracted therefrom.

* * * * *